US005305825A

United States Patent [19]

Roehrich et al.

[11] Patent Number: 5,305,825

[45] Date of Patent: Apr. 26, 1994

[54] AIR CONDITIONING AND REFRIGERATION APPARATUS UTILIZING A CRYOGEN

[75] Inventors: Roland L. Roehrich, Pittsburgh, Pa.; Herman H. Viegas, Bloomington; David H. Taylor, Minneapolis, both of Minn.

[73] Assignee: Thermo King Corporation, Minneapolis, Minn.

[21] Appl. No.: 982,548

[22] Filed: Nov. 27, 1992

[51] Int. Cl.[5] ..... F25B 29/00

[52] U.S. Cl. ..... 165/64; 165/61; 62/156; 62/239; 62/434

[58] Field of Search ..... 165/58, 61, 62, 64; 62/156, 159, 199, 239, 434

[56] References Cited

U.S. PATENT DOCUMENTS

| | | | |
|---|---|---|---|
| 3,621,673 | 11/1971 | Foust | 165/58 |
| 3,802,212 | 4/1974 | Martin et al. | 62/156 X |
| 4,045,972 | 9/1977 | Tyree, Jr. | 62/156 |
| 4,100,759 | 7/1978 | Tyree, Jr. | 62/165 X |
| 4,186,562 | 2/1980 | Tyree, Jr. | 62/239 X |
| 4,498,306 | 2/1985 | Tyree, Jr. | 62/239 X |
| 4,606,198 | 8/1986 | Latshaw et al. | 62/205 |
| 4,941,527 | 7/1990 | Toth et al. | 165/61 X |
| 5,040,374 | 8/1991 | Michaeu | 62/52.1 |
| 5,069,039 | 12/1991 | Martin | 62/156 X |
| 5,090,209 | 2/1992 | Martin | 62/156 X |

*Primary Examiner*—John Rivell
*Attorney, Agent, or Firm*—M. J. Moran

[57] ABSTRACT

A refrigeration system associated with a conditioned space to be controlled to a predetermined set point temperature via heating and cooling cycles. The refrigeration system includes a fluid flow path through which a predetermined fluid is circulated. The fluid flow path includes first, second and third heat exchangers. The first heat exchanger is disposed to condition air of the conditioned space, the second heat exchanger is in heat exchange relation with cryogenic cooling apparatus, and the third heat exchanger is in heat exchange relation with heating apparatus. The first and second heat exchangers are interconnected when the conditioned space requires a cooling cycle, and the first and third heat exchangers are interconnected when the conditioned space requires a heating cycle. Cryogen of the cryogenic cooling apparatus is thus not expended to heat the conditioned space, nor used for defrosting purposes.

17 Claims, 3 Drawing Sheets

AIR CONDITIONING AND REFRIGERATION APPARATUS UTILIZING A CRYOGEN

TECHNICAL FIELD

The invention relates in general to air conditioning and refrigeration systems, and more specifically to the use of a cryogen for controlling the temperature of a conditioned space associated with stationary and transport types of air conditioning and refrigeration systems.

BACKGROUND ART

Stationary and transport applications of air conditioning and refrigeration systems, with transport types including those used on straight trucks, tractor-trailer combinations, refrigerated containers, and the like, conventionally utilize a chlorofluorocarbon (CFC) refrigerant in a mechanical refrigeration cycle. The mechanical refrigeration cycle requires a refrigerant compressor driven by a prime mover, which often includes a dedicated internal combustion engine, such as a diesel engine. Because of the suspected depleting effect of CFC's on stratospheric ozone ($O_3$), practical alternatives to the use of CFC's are being sought.

The use of a cryogen, i.e., a gas which has been compressed to a very cold liquid state, such as carbon dioxide ($CO_2$) and nitrogen ($N_2$), in air conditioning and refrigeration systems is particularly attractive because, in addition to eliminating the need for a CFC, it also eliminates the need for a compressor and associated prime mover. Air conditioning and refrigeration systems of which we are aware which utilize a cryogen, implement a cooling cycle by circulating the cryogen through a fluid path which includes a heat exchanger disposed in heat exchange relation with air from a conditioned space. When a heating cycle is required to hold the temperature of the conditioned space within a narrow temperature range adjacent to a selected set point temperature, or a defrost cycle is required, the cryogen is heated via a suitable burner and combustible fuel, and the heated cryogen is circulated through the fluid path. Thus, cryogen is expended to the atmosphere during a cooling cycle, and cryogen plus a fuel associated with a fuel source, such as propane, liquid natural gas, diesel fuel, and the like, are expended to the atmosphere to implement heating and defrost cycles.

It would be desirable, and it is an object of the present invention, to provide new and improved cryogenic based air conditioning and refrigeration systems, which more effectively and efficiently utilize a cryogen, for lower cost operation, as well as for an extended operating time for a given vessel of cryogen.

SUMMARY OF THE INVENTION

Briefly, the present invention is an air conditioning and refrigeration system, hereinafter called a "refrigeration system", which is associated with a conditioned space to be controlled to a predetermined narrow temperature range adjacent to a selected set point temperature via heating and cooling cycles. The refrigeration system includes heating means, cryogenic cooling means, and a closed fluid flow path having a predetermined heat exchange fluid therein. The heat exchange fluid will hereinafter be called a "secondary fluid", with the primary fluid being a cryogen. Means, such as a pump, or a thermo-siphon arrangement, circulates the secondary fluid in the closed fluid path.

First, second and third heat exchanger means are disposed in the closed fluid flow path, with the first heat exchanger means conditioning the conditioned space. The second heat exchanger means is in heat exchange relation with the cryogenic cooling means, and the third heat exchanger means is in heat exchange relation with the heating means. The fluid flow path is configured via associated electrical control to interconnect the first and second heat exchanger means when the conditioned space requires a cooling cycle. When a heating/defrost cycle is required, the electrical control re-configures the fluid flow path to interconnect the first and third heat exchanger means. Thus, cryogen of the cryogenic cooling means is not utilized to heat the conditioned space, or the heat exchanger associated with the conditioned space, during heating and defrost cycles.

In a first embodiment of the invention the second heat exchanger means is directly associated with a cryogen supply vessel. This embodiment of the invention is suitable for use when the temperature of the cryogen in the supply vessel is thermodynamically compatible with the desired temperature f the conditioned space. For example, when the cryogen is $CO_2$ and the supply vessel is filled with $CO_2$ at a pressure of 100 psia and a temperature of −58° F. (−50° C.), conditioned space may be controlled to any temperature within the normal selectable operating range of the conditioned space, which in transport applications, for example, is usually −20° F. to +80° F. (−28.9° C. to +26.7° C.).

In another embodiment, an intermediate cryogenic vessel is provided, with expansion means being disposed between the primary supply vessel and the intermediate vessel. This arrangement is suitable when the primary supply vessel is filled with cryogen at a higher temperature than in the first example, e.g., with $CO_2$ at a pressure of 300 psia and a temperature of 0° F. (−17.8° C.). The cryogen is expanded from the primary vessel into the intermediate vessel to provide a desired lower pressure and lower temperature, e.g., 100 psia and −58° F. (−50° C.). This, for example, enables the lower end of the hereinbefore mentioned normal temperature range of a transport application to be thermodynamically achieved.

In a preferred embodiment of the invention, air mover means for moving air between the conditioned space and the first heat exchanger means includes a vapor motor which is driven by cryogen obtained from the supply vessel, or vessels, when two are used. To minimize the amount of cryogen required for driving the vapor motor, the cryogen is preferably heated to an elevated temperature via a burner and fuel supply.

The cryogen exiting the vapor motor, or the hot gases produced by the burner, may be directed to a pressure building arrangement associated with the primary supply vessel, to obtain the quantity of vaporized cryogen required to achieve a desired fan or blower horsepower.

When the refrigeration system is associated with a transport application which includes a driven vehicle, a portion of the heat exchange fluid may be used to condition the air of a driver's cab when the vehicle is parked and occupied, making it unnecessary to keep the vehicle engine running. In such an application, the vapor motor may be arranged to drive an electrical alternator or generator for maintaining a vehicle battery fully charged while the vehicle is parked with the engine off. Thus, an electrical motor may be used to circulate cab air in heat exchange relation with a cab mounted heat exchanger, through which a portion of the secondary fluid of the refrigeration system is circulated.

When the conditioned space is compartmentalized, having two or more conditioned spaces, the secondary fluid may be directed successively through heat exchangers associated with each conditioned space, starting with the lowest temperature conditioned space and successively proceeding to each higher temperature conditioned space.

An alternative arrangement when the conditioned space is compartmentalized includes connecting heat exchangers associated with the different conditioned spaces in parallel with respect to the supply of cryogen, instead of in series. The flow rates of the cryogen through each heat exchanger are individually controlled to satisfy the temperature requirements of their associated compartments.

BRIEF DESCRIPTION OF THE DRAWINGS

The invention will become more apparent by reading the following detailed description in conjunction with the drawings, which are shown by way of example only, wherein.

DESCRIPTION OF PREFERRED EMBODIMENTS

As used in the following description and claims, the term "conditioned space" includes any space to be temperature and/or humidity controlled, including stationary and transport applications for the preservation of foods and other perishables, maintenance of a proper atmosphere for the shipment of industrial products, space conditioning for human comfort, and the like. The term "refrigeration system" is used to generically cover both air conditioning systems for human comfort, and refrigeration systems for preservation of perishables and shipment of industrial products. Also, when it is stated that the temperature of a conditioned space is controlled to a selected set point temperature, it is to be understood that the temperature of the conditioned space is controlled to a predetermined temperature range adjacent to the selected set point temperature. In the Figures, valves which are normally open (n.o.), are illustrated with an empty circle, and valves which are normally closed (n.c.) are illustrated with an "X" within a circle. Of course, the associated electrical or electronic control, hereinafter called "electrical control", may be changed to reverse the de-energized states shown. An arrow pointed at a valve in the Figures indicates that the valve is, or may be, controlled by the electrical control.

The invention is suitable for use when the refrigeration system is associated with a single conditioned space to be controlled to a selected set point temperature; and, the invention is also suitable for use when the refrigeration system is associated with at least first and second separate conditioned spaces to be individually controlled to selected first and second set point temperatures.

Figure 1:
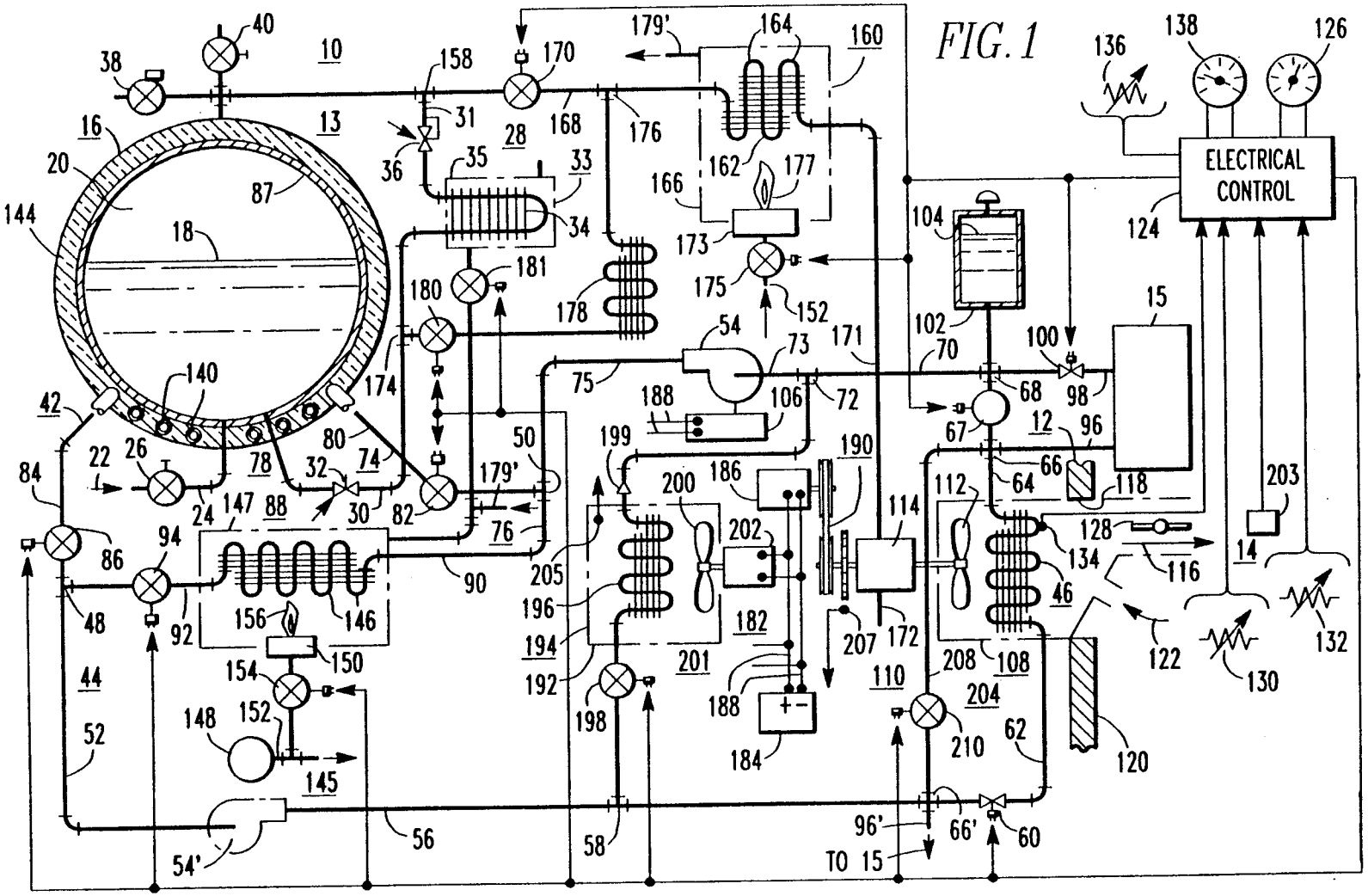
FIG. 1 is diagrammatic representation of a refrigeration system constructed according to a first embodiment of the invention wherein a cryogen-to-secondary fluid heat exchanger is associated directly with a supply vessel.

Referring now to the drawings, and to FIG. 1 in particular, there is shown a refrigeration system 10 suitable for use with any conditioned space, and particularly well suited for use on straight trucks, tractor-trailer combinations, containers, and the like, with the word "vehicle" being used to generically refer to the various transport vehicles which utilize refrigeration systems.

Refrigeration system 10 may be used in stationary and transport applications, with reference number 12 generally indicating a vehicle in a transport application. Refrigeration system 10 may be associated with a single conditioned space 14 to be controlled to a pre-selected set point temperature, and as hereinbefore stated, it may also be associated with two or more separate conditioned spaces to be individually controlled to selected set point temperatures. A second conditioned space and associated air conditioning means is indicated generally at 15. In a compartmentalized transport arrangement, for example, conditioned space 14 may be used to condition a frozen load, while the conditioned space indicated at 15 is conditioning a fresh load; or, fresh loads may be conditioned in each, with the optimum temperature for each load being maintained.

Refrigeration system 10 includes cryogenic cooling means 13. Cryogenic cooling means 13 includes a thermally insulated vessel 16 containing a suitable cryogen, such as nitrogen ($N_2$), or carbon dioxide ($CO_2$), for example, with the liquid phase of the cryogen being indicated at 18. Vessel 16 also contains cryogen 20 in vapor form, above the liquid level. Vessel 16 may be filled, for example, by connecting ground support apparatus, indicated generally at 22, to a supply line or conduit 24 which includes a valve 26.

Vapor pressure in vessel 16 is maintained above a predetermined value by a pressure building and regulating arrangement 28 in which conduits 30 and 31 respectively connect pressure building means 33 to lower and upper points of vessel 16. Conduit 30, which connects a low point of vessel 16 to pressure building means 33, includes a valve 32. The pressure building means 33 includes a vaporizing coil 34, which may be directly exposed to ambient temperatures, or which may be disposed within a housing 35, as will be hereinafter explained. Conduit 31, which connects pressure building means 33 to a high point of vessel 16, includes a valve 36. Valve 36 maintains the vapor pressure in vessel 16 at a predetermined level above a predetermined value, which may be determined and selected each time vessel 16 is filled, if necessary. A pressure reading safety valve 38 is provided in conduit 31 at a point where the vapor pressure in vessel 16 may be directly sensed. A venting valve 40 is also provided to facilitate the vessel filling process. Valve 40 may be connected to ground support apparatus 22 during filling, if desired.

Valve 32 opens when the pressure in vessel 16 falls to a predetermined value. The predetermined value is selected to enable the cryogen to flow into the pressure building arrangement 28. When the cryogen is $CO_2$ the predetermined value is selected to be above the triple point of $CO_2$, i.e., 75.13 psia, and in this instance arrangement 28 regulates the vapor pressure in vessel 16 to at least about 80 psia.

As hereinbefore stated, valve 32 admits liquid cryogen into vaporizing coil 34, and vaporizing coil 34 is exposed to ambient temperature. As disclosed in concurrently filed application Ser. No. 07/982,333, vaporizing coil 34 may be exposed to higher temperatures than ambient, especially during low ambient temperature conditions, by utilizing gases produced by products of combustion of a fuel used during heating and defrost cycles, and also from a fuel used to produce higher fan horsepower; or, by utilizing cryogen which is warmer than the ambient temperature, just before it is exhausted to the atmosphere.

Using $CO_2$ as an example of a suitable cryogen, vessel 16 may be filled with $CO_2$ at an initial pressure of about 100 psia and an initial temperature of about −58° F. (−50° C.), which will thermodynamically satisfy the low temperature end of a normal temperature control range of a transport refrigeration application. Of course, other pressures and temperatures may be used than set forth in this example, as long as the temperature of the cryogen will be able to thermodynamically maintain the desired set point temperature, or temperatures, in the associated conditioned space, or spaces.

The present invention includes a fluid flow path 42, which will be called a "closed" fluid flow path as it is completely isolated from any direct contact with the cryogen 18 and 20, and from any direct contact with air in conditioned space 14. Closed fluid flow path 42 may be at atmospheric pressure, or pressurized, as desired.

The closed fluid flow path 42 includes a first portion 44 having a first heat exchanger 46. The first portion 44 extends between tees 48 and 50, with the first portion 44 including, from tee 48 to tee 50, a conduit 52, an optional position for a pump, shown in broken outline and referenced pump 54', a conduit 56, a tee 58, a flow control valve 60, a conduit 62, the first heat exchanger 46, a conduit 64, a connector 66, a valve 67, a connector 68, a conduit 70, a tee 72, a conduit 73, a preferred location for the pump, shown in solid outline and referenced pump 54, and a conduit 75.

The closed fluid flow path 42 includes second and third portions 74 and 76 which are connected in parallel with the first portion 44, each extending between tees 48 and 50. The second portion 74 includes a second heat exchanger 78, which is connected between tees 50 and 48 via a conduit 80 which includes a valve 82, and a conduit 84 which includes a valve 86. The second heat exchanger 78 is illustrated as being in heat exchange relation with a wall 87 of vessel 16, but heat exchanger 78 may be disposed within vessel 16, in direct heat exchange relation with cryogen 18, if desired. The third fluid flow path portion 76 includes a third heat exchanger 88, which is connected between tees 50 and 48 via a conduit 90, and a conduit 92 which includes a valve 94.

The second conditioned space and associated air conditioning apparatus, indicated at 15, is provided when conditioned space 14 is compartmentalized to define one or more additional conditioned spaces. In a first embodiment, apparatus 15 is connected in series with heat exchanger 46, with apparatus 15 being connected between connector 66 and connector 68 via conduits 96 and 98, with one of the conduits, such as conduit 98, including a flow control valve 100. Valve 67 is closed when apparatus 15 is operational.

In a second embodiment of apparatus 15, apparatus 15 is connected in parallel with heat exchanger 46, instead of in series, with respect to supply vessel 16. In this alternate embodiment, connector 66 is located in conduit 56 instead of in conduit 64, as indicated by connector 66' and conduit 96', and valve may be replaced by a check valve.

An expansion and fill tank 102, for filling the closed fluid flow path 42 with a heat-exchange or secondary fluid 104, and also for allowing temperature induced expansion and contraction of the secondary fluid 104, is connected to four-way connector 68. Tank 102 and the closed fluid flow path may be pressurized, depending upon the specific secondary fluid selected. The secondary fluid 104 should be a wide range liquid coolant selected to have good heat transfer and good transport properties while remaining in a liquid state throughout the different temperatures it will be subjected to. Examples of a suitable fluid for the secondary fluid include ethylene glycol and D-Limonene, with the latter being a trade name of Florida Chemical Co., Inc., Lake Alfred, Fla.

The first heat exchanger 46 is associated with an air conditioning means 108 which includes air mover means 110. Air mover means 110 includes a fan or blower 112 driven by a suitable motor 114. In a preferred embodiment of the invention, motor 114 is a vapor driven motor or turbine, hereinafter referred to as vapor motor 114, which is driven by vaporized cryogen obtained from supply vessel 16 by arrangements which will be hereinafter explained. Air conditioning means 108 directs conditioned or discharge air, indicated by arrow 116, into conditioned space 14, via an opening 118 in a wall 120 surrounding conditioned space 14. Return air from conditioned space 14, indicated by arrow 122, is drawn through opening 118 by air mover means 110, and into heat exchange relation with the first heat exchanger 46.

Pump 54 may be belt driven by vapor motor 114, or driven by an electric motor 106. Hydraulic and pneumatic motors may also be used. A suitable source of electrical power for motor 106 will be hereinafter described.

Electrical control apparatus 124 is provided to control the temperature of conditioned space 14 to a predetermined set point temperature which is selected by a set point temperature selector 126. Electrical control 124 controls the temperature of conditioned space 14 via cooling and heating cycles, and also defrosts the first heat exchanger 46, and a heat exchanger associated with apparatus 15, to remove water ice build-up via a heating cycle. When air mover means 110 remains operational during a defrost cycle, a controllable damper 128 is provided to selectively close opening 118 during defrost. Damper 128 may be electrically operated, or pneumatically operated, such as by using the pressure of the cryogen in supply vessel 16. Electrical control 124 receives inputs from a return air temperature sensor 130, a discharge air temperature sensor 132, a coil temperature sensor 134, and an ambient air temperature sensor 136. When more than one conditioned space is temperature controlled, such as the additional conditioned space and air conditioning apparatus indicated generally at 15, a set point temperature selector is also provided for each additional conditioned space, such as the set point temperature selector 138. The additional conditioned space and associated air conditioning apparatus 15 may be constructed in the same manner as conditioned space 14 and the associated air conditioning means 108, and is thus not shown in detail. Fans or blowers in the additional conditioned spaces may be directly driven, or belt driven, by electric, hydraulic, pneumatic, or vapor motors, as desired.

The return air temperature, discharge air temperature, and ambient air temperature determine when electrical control 124 commands cooling and heating cycles, and the temperature of the coil surface of the first heat exchanger 46, detected by sensor 134, determines when a defrost cycle should be initiated. A defrost cycle may also be initiated by other means, such as by a timer, by a manually actuated switch, by a programmed algorithm, and the like.

The second heat exchanger 78 is associated with cryogen cooling means 13, removing heat from the secondary fluid 104, and transferring the heat into the liquid cryogen 18. The second heat exchanger 78 may be constructed as illustrated in FIG. 1, having a plurality of coil turns or loops 140 in thermal contact with the surface of wall 87 of vessel 16. Thermal insulation 144 surrounds vessel wall 87 as well as the coil loops 140. A vacuum tank may also be used. A suitable alternate construction arrangement for the second heat exchanger 78 includes directing conduits 80 and 84 through the vessel wall 87, with the turns or loops 140 of the heat exchanger being inside vessel 16, submerged in liquid cryogen 18.

The third heat exchanger 88 includes a plurality of coil turns or loops 146 disposed within a suitable housing 147, with coil turns 146 being provided with fins, if necessary. Coil turns 146 are heated by heating means 145. Heating means 145 includes a fuel source 148, such as propane, liquid natural gas, diesel fuel, and the like. In stationary applications, other sources may be used to heat the cryogen, such as electric power, hot liquids, steam, waste gases, and the like. Fuel from source 148 is selectively connected to a burner 150 via a conduit 152 and a valve 154. When control 124 opens valve 154 to initiate the heating of coil turns 146 and the secondary fluid 104 therein, burner 150 is simultaneously ignited to provide a flame indicated at 156.

As disclosed in concurrently filed application Ser. No. 07/982,364, FIG. 1 illustrates providing independent control over fan or blower 112, enabling fan or blower 112 to circulate air throughout conditioned space 14 during cooling and heating cycles, and also during a null cycle initiated when refrigeration system 10 does not require heating or cooling to maintain the selected set point temperature in conditioned space 14.

More specifically, vaporized cryogen for operating vapor motor 114, independent of whether electrical control apparatus 124 is commanding cooling, heating, or null cycles in the conditioned spaces 14 and 15, is provided by tapping conduit 31 via a tee 158 and drawing vaporized cryogen 20 from vessel 16 and from the pressure building and regulating arrangement 28. To reduce the amount of cryogen required to operate vapor motor 114 and provide the desired fan horsepower, the vaporized cryogen 20 is preferably heated in heating means 160.

Heating means 160 includes a heat exchanger 162 having a plurality of coil turns or loops 164 disposed within a suitable housing 166. An input side of heat exchanger 162 is connected to tee 158 via a conduit 168 which includes a valve 170, and an output side of heat exchanger 162 is connected to an input side of vapor motor 114 via a conduit 171. An output side of vapor motor 114 is connected to an exhaust conduit 172. Heating means 160 includes a burner 173 which may be connected to conduit 152 from fuel source 148 via a valve 175, or a separate fuel source, as desired. In stationary applications of refrigeration system 10, cryogen from conduit 172 may be collected and compressed into a cryogenic state for reuse.

The separate, isolated heating arrangements for heating the secondary fluid 104 and for heating the cryogen for increased fan horsepower are preferred, as they eliminate the necessity of taking steps to prevent heat from being transferred into the secondary fluid during a cooling cycle. However, with proper thermal insulation, both heating functions may take place at a single location.

When electrical control 124 opens valve 175, burner 173 is ignited to provide a flame 177 which heats coil turns 164 and the vaporized cryogen therein to a desired temperature. Drawing vaporized cryogen 20 from vessel 16 is desirable because the heat of vaporization removes heat from the liquid cryogen 18.

If the fan horsepower requirements demand more vaporized cryogen than available from the upper portion of vessel 16, additional cryogen may be provided by tapping conduit 30 with a tee 174, tapping conduit 168 with a tee 176, and connecting an ambient coil or loop 178 between tees 174 and 176 via a valve 180.

Figure 2:
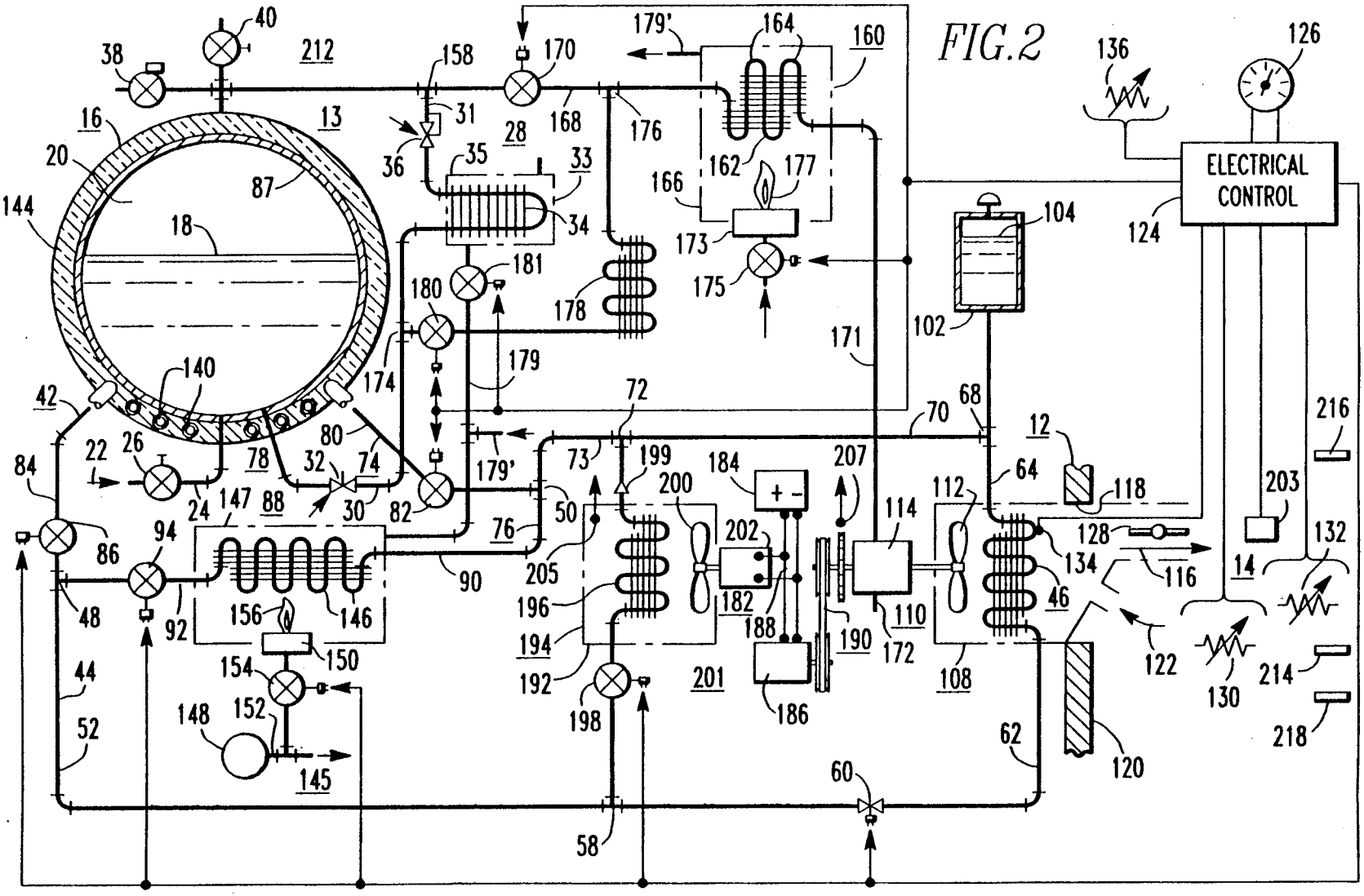
FIG. 2 is a diagrammatic representation of a refrigeration system which is similar to that of FIG. 1 except instead of using a pump for circulating a secondary fluid, a thermosiphon arrangement is illustrated.

In another embodiment, additional vaporized cryogen is provided without requiring the addition of ambient loop 178, by using heat generated by refrigeration system 10 during the normal operation thereof to enhance the heating of coil 34. This arrangement is especially advantageous during low ambient temperatures. For example, as shown in FIGS. 1 and 2, hot gases produced by burner 173 and/or burner 150, are respectively directed from housings 166 and 147 to housing 35 via conduits 179 and 179' and a valve 181. Alternatively, as will be hereinafter described relative to FIG. 3, exhaust conduit 172 may be directed to housing 35, to utilize heat in the vaporized cryogen exiting vapor motor 114, before the cryogen is vented to the atmosphere.

Pump drive motor 106 may be connected to an electrical power supply 182 which includes a battery 184, which may be the vehicle battery in a transport application, or a separate battery. Battery 184 is maintained in a fully charged condition by an alternator or generator 186 and an electric circuit 188. In a preferred embodiment of the invention, alternator or generator 186 is driven by vapor motor 114, such as via a pulley and drive belt arrangement 190. Alternator 186 may alternately be driven by cryogen exhaust 172.

Tees 58 and 72 are provided in fluid flow path portion 44 when refrigeration system 10 is utilized in an application which requires both refrigeration and air conditioning. For example, in a transport application associated with a driven vehicle 12, in addition to conditioning space 14, a driver's cab 192 may be air conditioned while vehicle 12 is parked and occupied, making it unnecessary to operate the vehicle engine. An air conditioning arrangement 194 for cab 192 includes a heat exchanger 196 connected between tees 58 and 72 via a valve 198 and a check valve 199. Arrangement 194 also includes air mover means 201 which comprises a fan or blower 200 connected to a drive motor 202. Drive motor 202 may be an electric motor, for example, which is connected to electric circuit 188. Thus, the cab air conditioning system 194 may be operated with the vehicle engine off, even when battery 184 is the vehicle battery, as battery 184 is maintained in a fully charged condition by operation of vapor motor 114. A cab air temperature sensor 205 provides an input to electrical control 124.

Electrical control 124, in response to temperature sensor 205, operates valve 198 to by-pass a portion of the secondary fluid 104 around the first heat exchanger 46 and through heat exchanger 196. The temperature requirements in cab 192 will normally be consistent with the temperature requirements in conditioned spaces 14 and 15. For example, during cold ambient temperatures, the conditioned spaces 14 and 15 and cab 192 will predominately require heating cycles, and during warm ambient temperatures, the conditioned spaces 14 and 15 and cab 192 will predominately require cooling cycles. Valve 198 may be operated on/off to provide the desired heating or cooling, or valve 198 may be a valve which controls the orifice size and thus the flow rate to obtain the desired heating or cooling.

When electrical control 124 detects the need for a cooling cycle in conditioned space 14 to maintain the associated set point temperature selected on set point selector 126, electrical control 124 energizes and thus opens valves 82, 86 and 170, and electrical control 124 controls flow control valve 60 to control the flow rate of the secondary fluid 104 through the first heat exchanger 46. Cooled secondary fluid 104 is pumped from the second heat exchanger 78 to the first heat exchanger 46 via conduits 84, 52, 56, and 62. Heat in the return air 122 from conditioned space 14 is transferred to the secondary fluid 104, and the heated secondary fluid is pumped to the second heat exchanger 78 via conduits 64, 70, 73, 75 and 80. Heat is transferred from the heated secondary fluid into the liquid cryogen 18, and then removed therefrom by the heat of vaporization as liquid cryogen 18 vaporizes to provide vaporized cryogen 20 for the operation of vapor motor 114.

When the second conditioned space and air conditioning apparatus 15 is connected in series with heat exchanger 46, and a cooling cycle is required in apparatus 15, flow control valve 100 is opened by electrical control 124 to allow secondary fluid in conduit 64 to circulate through the associated heat exchanger. The temperature of a conditioned space associated with air conditioning apparatus 15 is selected via selector 138 to be a higher temperature conditioned space than conditioned space 14. For example, conditioned space 14 may contain a frozen load, and the conditioned space associated with apparatus 15 may contain a fresh load. If both conditioned spaces contain fresh loads, conditioned space 14 would be associated with the load which requires the temperature to be maintained the closest to freezing point of 32° F. (0° C.).

When apparatus 15 is connected in parallel with heat exchanger 46 via connector 66' and conduit 96', valve 100 is opened by electrical control 124 to allow secondary fluid 104 in conduit 56 to circulate through the associated heat exchanger. In this embodiment, apparatus 15 is not subject to the limitation of controlling to a higher temperature than the temperature in conditioned space 14.

If air flow in conditioned space 14 during a cooling cycle is insufficient, as detected by an air flow rate feedback sensor 203, or as detected by a speed or RPM sensor 207 associated with vapor motor 114, electrical control 124 opens valve 180, when ambient loop 178 is provided; or electrical control 124 opens valve 181 when it is desired to add by-product heat to pressure regulating coil 34.

When a heating cycle is required to hold the set point temperature in conditioned space 14, electrical control 124 closes valves 82 and 86, to completely isolate the second heat exchanger 78 from the secondary fluid flow path 44, valves 94 and 154 are opened, and burner 150 is ignited. The secondary fluid 104 is then pumped through the coil turns 146 of the third heat exchanger 88, with the heated secondary fluid 104 being directed to the first heat exchanger 46 via the now open valve 94 and conduits 52, 56 and 62. Secondary fluid from heat exchanger 46 is directed back to the third heat exchanger 88 via conduits 64, 70, 73, 75 and 90. A defrost cycle to defrost and remove water ice which may build up on the first heat exchanger 46 during a cooling cycle is similar to the heating cycle, except damper 128 is closed, to prevent warm air from being discharged into conditioned space 14; or, alternatively, valve 170 may be closed during a defrost cycle and burner 173 turned off, to stop vapor motor 114 from operating during a defrost cycle.

When the second conditioned space shown generally at 15 requires heat during a heating cycle associated with the first conditioned space 14, valve 100 is controlled accordingly. When conditioned space 14 is associated with a frozen load a heating cycle for conditioned space 14 is not required, and thus a controllable by-pass arrangement 204 may be provided to by-pass the first heat exchanger 46 in the first or series embodiment of apparatus 15. By-pass arrangement 204 includes the connector 66' in conduit 56, and a conduit 208 disposed between connector 66' and connector 66, with conduit 208 including a valve 210. Thus, electrical control 124 may independently serve the cooling, heating, and defrost requirements of conditioned spaces 14 and 15 by controlling valves 60, 100, and 210. When heat exchanger 46 requires defrosting while apparatus 15 is in a cooling cycle, heated secondary fluid 104 is passed through heat exchanger 46, by-passing apparatus 15 by closing valve 100 and opening valve 67. When apparatus 15 requires a defrost cycle while heat exchanger 46 is in a cooling cycle, valves 60 and 67 are closed and valves 210 and 100 are opened, while heated secondary fluid 104 is circulated through the heat exchanger of apparatus 15. In the second or parallel embodiment of apparatus, each parallel path is independently controlled in a similar manner to implement defrost cycles.

FIG. 2 is a diagrammatic representation of a refrigeration system 212 which is similar to refrigeration system 10 shown in FIG. 1 except illustrating a thermo-siphon arrangement for circulating the secondary fluid 104, eliminating the need for pump 54 of the FIG. 1 embodiment. Like reference numerals in FIGS. 1 and 2 indicate like components and thus they are not described again relative to FIG. 2. In the thermosiphon arrangement of FIG. 2 it is important that the second heat exchanger 78 be located at an elevation higher than the elevation of the first heat exchanger 46, and that the first heat exchanger 46 be located an elevation which is higher than the elevation of the third heat exchanger 88. The relative elevations of the first, second and third heat exchangers 46, 78 and 88 are respectively indicated at 214, 216 and 218.

In the thermosiphon arrangement of FIG. 2, during a cooling cycle, the secondary fluid leaving the first heat exchanger 46 will be warmer than the secondary fluid in the second heat exchanger 78, providing a thermal gradient which moves the warmer secondary fluid upward to the second heat exchanger 78, and the cooler secondary fluid from the second heat exchanger 78 downward to the first heat exchanger 46. Valve 94 will be closed to prevent circulation through the third heat exchanger 88. In like manner, during a heating cycle, valves 82 and 86 will be closed and valve 94 open. The secondary fluid leaving the third heat exchanger 88 will be warmer than the secondary fluid in the first heat exchanger 46, providing a thermal gradient which moves the warmer secondary fluid upward to the first heat exchanger 46, and the cooler secondary fluid in the first heat exchanger 46 downward to the third heat exchanger 88.

Figure 3:
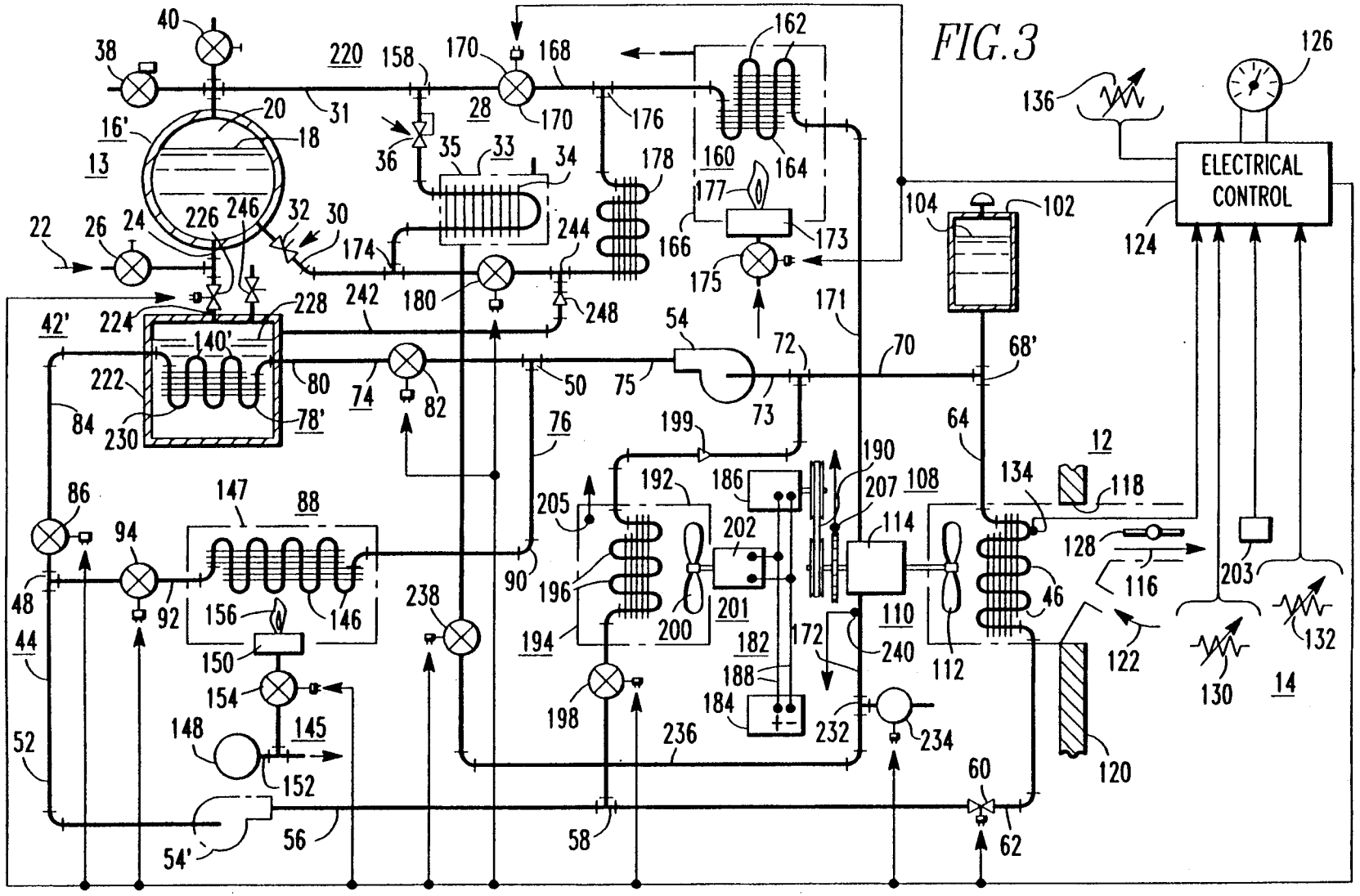
FIG. 3 is a diagrammatic representation of a refrigeration system constructed according to another embodiment of the invention wherein the cryogen of a primary supply vessel is expanded into an intermediate vessel to obtain a desired temperature of the cryogen, with the cryogen-to-secondary fluid heat exchanger being associated with the intermediate vessel.

FIG. 3 is a diagrammatic representation of a refrigeration system 220 constructed according to another embodiment of the invention. Like reference numerals in FIGS. 1 and 3 indicate like components and thus they are not described again during the description of the FIG. 3 embodiment. The embodiment of FIG. 3 is suitable for use when the cryogen in supply vessel 16 is delivered at a temperature which is too high to thermodynamically meet the requirements of the low end of the temperature range of refrigeration system 220. For example, the liquid cryogen 18 may be $CO_2$ delivered from ground support apparatus 22 at a pressure of 300 psia and a temperature of 0° F. (−17.8° C.), while the low end of the selectable cooling range may be well below that temperature, such as to −20° F. (−28.9° C.).

Refrigeration system 220 differs primarily from refrigeration system 10 by providing an intermediate vessel 222 connected to a low point of the primary storage vessel 16', which is indicated with a prime mark to note the removal of heat exchanger 78 therefrom, via a conduit 224 which includes an expansion valve 226. Liquid cryogen 18 in vessel 16 is expanded into intermediate vessel 222 via expansion valve 226 to provide a pressure in vessel 222 which corresponds to the desired state of cryogen 228 in vessel 222. For example, the desired state may be liquid, snow, or a liquid/snow slush. The second heat exchanger 78 of the FIG. 1 embodiment, which is referenced 78' in the embodiment of FIG. 3 since it is associated with intermediate vessel 222 instead of supply vessel 16', is disposed in heat exchange relation with the cryogen 228. As illustrated, the second heat exchanger 78' may include a plurality of turns or loops 230 disposed inside the intermediate vessel 222, and submerged in the cryogen 228. Alternate construction arrangements for the secondary fluid side of the second heat exchanger 78' include a double bottom design with the secondary fluid circulating in the lower segment; a coil at the bottom of tank 222, internal or external; a coil, such as a cylindrically shaped plate type coil, in thermal contact with the outside diameter of vessel 222; and, a double side wall vessel construction forming a jacket around the vessel. The design construction chosen depends upon the cryogen used, and the desired state of the cryogen 228 in the secondary vessel 222. The construction chosen may include fins on the cryogen side and/or the secondary fluid side, as desired.

Another distinction between the refrigeration system 220 of FIG. 3 and the refrigeration system 10 of FIG. 1 is in the use of the warm vaporized cryogen exiting vapor motor 114 to selectively heat the pressure regulating coil 34, instead of using hot gases produced by burners 150 and/or 173. Exhaust conduit 172 is connected to a tee 232, with one branch, when open, discharging the cryogen to the atmosphere via a valve 234, or to vapor collection apparatus in a stationary application. The remaining branch, when open, connects the exhaust conduit 172 to the housing 35 which surrounds pressure regulating coil 34. This connection includes a conduit 236 and a valve 238. Thus, when the temperature of the cryogen exiting vapor motor 114, detected by a temperature sensor 240, exceeds the ambient temperature detected by temperature sensor 136, and vapor motor 114 requires more horsepower to increase the air flow rate in conditioned space 14, such as detected by air flow sensor 203, or by speed sensor 207, electrical control 124 closes valve 234 and opens valve 238, to direct the warm cryogen to coil 34 within housing 35.

A still further distinction includes the option of providing vaporized cryogen from the intermediate vessel 222 for enhancing fan horsepower. This additional vaporized cryogen is provided via a conduit 242 which extends from an upper point of vessel 222 to a tee 244 connected between valve 180 and ambient loop 178. This option exists when a pressure relief valve 246 associated with intermediate vessel 222 is set high enough to provide vaporized cryogen for fan operation at the desired pressure. A check valve 248 in conduit 242 prevents a reverse flow when the pressure in conduit 242 is less than the pressure in the ambient loop 178.

The embodiment of the invention shown in FIG. 3 may also utilize the multiple conditioned space arrangement of FIG. 1, and it may also utilize the thermosiphon arrangement of FIG. 2 by placing the intermediate vessel 222 and second heat exchanger 78' at a higher elevation than the first heat exchanger 46, and by placing the first heat exchanger 46 at a higher elevation than the third heat exchanger 88.

While not illustrated, it is to be understood that in transport applications blowers and/or fans driven by electrical motors powered by the vehicle electrical system, or other suitable sources, may augment and/or replace the vapor motors, for moving air between the conditioned spaces and the associated heat exchangers. This is also applicable to stationary applications, with electrical mains being used to power electrical motors connected to fans and/or blowers. Also, in transport applications, the vapor motors may drive electrical generators or alternators for the purpose of charging batteries associated with the refrigeration system control.

We claim:

1. A refrigeration system associated with a conditioned space to be controlled to a predetermined set point temperature via heating and cooling cycles, with the refrigeration system including heating means and cryogenic cooling means, the improvement comprising:

a fluid flow path, a predetermined fluid in said fluid flow path, means for circulating said fluid in said fluid flow path, first, second and third heat exchanger means in said fluid flow path, said first heat exchanger means being disposed to condition the conditioned space, said second heat exchanger means being in heat exchange relation with the cryogenic cooling means, said third heat exchanger means being in heat exchange relation with the heating means, means configuring the fluid flow path to interconnect the first and second heat exchanger means when the conditioned space requires a cooling cycle, and means configuring the fluid flow path to interconnect the first and third heat exchanger means when the conditioned space requires a heating cycle.

2. The refrigeration system of claim 1 wherein the means for circulating the fluid in the fluid flow path includes a pump.

3. The refrigeration system of claim 1 wherein the means for circulating the fluid in the fluid flow path includes a thermosiphon arrangement wherein the first heat exchanger means is disposed at a lower elevation than the second heat exchanger means, and at a higher elevation than the third heat exchanger means.

4. The refrigeration system of claim 1 wherein the predetermined fluid is a liquid which remains in a liquid state while being cooled in the second heat exchanger means, and also while being heated in the third heat exchanger means.

5. The refrigeration system of claim 1 wherein the cryogenic cooling means includes a supply vessel which contains a cryogen, with the second heat exchanger means being in heat exchange relation with the supply vessel.

6. The refrigeration system of claim 1 wherein the cryogenic cooling means includes a supply vessel which contains a cryogen at a predetermined temperature and a predetermined pressure, an intermediate vessel, and expansion means between the supply and intermediate vessels which provides cryogen in the second vessel which is at a lower pressure and a lower temperature than the cryogen in the supply vessel, with the second heat exchanger means being in heat exchange relation with the intermediate vessel.

7. The refrigeration system of claim 1 wherein the heating means includes a supply of combustible fuel which is ignited during a heating cycle to heat the fluid in the third heat exchanger means.

8. The refrigeration system of claim 1 wherein the fluid flow path includes an expansion tank.

9. The refrigeration system of claim 1 including air moving means for circulating air from the conditioned space in heat exchange relation with the first heat exchanger means, with the air moving means including fan means driven by vapor motor means, and wherein the vapor motor means is driven by cryogen from the cryogenic cooling means.

10. The refrigeration system of claim 9 including means for heating the cryogen, and wherein the heated cryogen is utilized to drive the vapor motor means.

11. The refrigeration system of claim 9 wherein the cryogenic cooling means includes a supply vessel containing liquid cryogen, and including pressure building means which vaporizes liquid cryogen from the supply vessel, with the vaporized cryogen maintaining a predetermined pressure in the supply vessel and also providing vaporized cryogen for driving the vapor motor.

12. The refrigeration system of claim 11 including means for heating the cryogen, with the heated cryogen being utilized to drive the vapor motor means, and means directing cryogen exiting the vapor motor means in heat exchange relation with the pressure building means, to enhance the transformation of liquid cryogen to vaporized cryogen for use by the vapor motor means.

13. The refrigeration system of claim 11 including means for heating the cryogen, generating hot gases as a by-product, with the heated cryogen being utilized to drive the vapor motor means, and means directing the hot by-product gases in heat exchange relation with the pressure building means, to enhance the transformation of liquid cryogen to vaporized cryogen for use by the vapor motor means.

14. The refrigeration system of claim 9 wherein the cryogenic cooling means includes cryogen in a liquid state, means for vaporizing said liquid cryogen, and means for directing the vaporized cryogen to the vapor motor means.

15. The refrigeration system of claim 1 including a vehicle having a cab space to be air conditioned, fourth heat exchanger means associated with said cab space for conditioning the air thereof, and means for selectively directing at least a portion of the fluid in the fluid flow path through said fourth heat exchanger means.

16. The refrigeration system of claim 15 including electrical generator means driven by the vapor motor, and including air mover means for circulating air in the cab space in heat exchange relation with the fourth heat exchanger means, with said air mover means including fan means driven by electric motor means, with electrical energy for driving said electric motor being at least in part being provided by said electrical generator means.

17. The refrigeration system of claim 16 wherein the vehicle includes a battery, with the electrical generator means charging said battery, at least while fluid in the fluid flow path is conditioning the cab space.

* * * * *